US009164410B2

(12) United States Patent
Kmiecik-Lawrynowicz et al.

(10) Patent No.: US 9,164,410 B2
(45) **Date of Patent: *Oct. 20, 2015**

(54) TONER COMPOSITIONS FOR SINGLE COMPONENT DEVELOPMENT SYSTEM

(71) Applicant: XEROX CORPORATION, Norwalk, CT (US)

(72) Inventors: Grazyna E. Kmiecik-Lawrynowicz, Fairport, NY (US); Maura A. Sweeney, Irondequoit, NY (US); Daniel W. Asarese, Honeoye Falls, NY (US); Samir Kumar, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 88 days.

This patent is subject to a terminal disclaimer.

(21) Appl. No.: 13/930,938

(22) Filed: Jun. 28, 2013

(65) Prior Publication Data

US 2015/0004536 A1 Jan. 1, 2015

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 9/093*** | (2006.01) |

(52) U.S. Cl.

CPC ..... *G03G 9/09775* (2013.01); *G03G 9/08782* (2013.01); *G03G 9/09321* (2013.01); *G03G 9/09328* (2013.01); *G03G 9/09335* (2013.01); *G03G 9/09364* (2013.01); *G03G 9/09716* (2013.01); *G03G 9/09725* (2013.01); *G03G 9/09733* (2013.01); *G03G 9/0819* (2013.01); *G03G 9/0827* (2013.01)

(58) Field of Classification Search

CPC ..... G03G 9/09797; G03G 9/08755; G03G 9/0819; G03G 9/09708; G03G 9/09716; G03G 9/09725

USPC ..... 430/108.1, 108.6, 108.7

See application file for complete search history.

(56) References Cited

U.S. PATENT DOCUMENTS

| | | | | |
|---|---|---|---|---|
| 8,123,344 | B2 | 2/2012 | Goredema et al. | |
| 8,221,953 | B2 | 7/2012 | Morales-Tirado et al. | |
| 8,252,493 | B2 | 8/2012 | Kumar et al. | |
| 8,292,404 | B2 | 10/2012 | Zhao et al. | |
| 8,308,859 | B1 | 11/2012 | Belelie et al. | |
| 8,313,666 | B2 | 11/2012 | Iftime et al. | |
| 2003/0129516 | A1 * | 7/2003 | Nakamura et al. | 430/108.21 |
| 2003/0190544 | A1 * | 10/2003 | Tanaka et al. | 430/108.23 |
| 2011/0086304 | A1 | 4/2011 | Asarese et al. | |
| 2012/0129088 | A1 | 5/2012 | Kmiecik-Lawrynowicz et al. | |
| 2012/0129089 | A1 * | 5/2012 | Kmiecik-Lawrynowicz et al. | 430/108.3 |
| 2013/0101934 | A1 * | 4/2013 | Chiba et al. | 430/108.7 |
| 2013/0260303 | A1 * | 10/2013 | Kmiecik-Lawrynowicz et al. | 430/108.3 |

* cited by examiner

*Primary Examiner* — Hoa V Le
(74) *Attorney, Agent, or Firm* — Shimokaji IP

(57) ABSTRACT

A toner composition with a novel surface additive package for developing images is provided. The additive package comprises a sol-gel silica, a PDMS silica, an HMDS silica, and an organic spacer such as PMMA, and melamine. The toner composition exhibits improved properties and are useful for high speed printing on Single Component Development systems.

11 Claims, 2 Drawing Sheets

TONER COMPOSITIONS FOR SINGLE COMPONENT DEVELOPMENT SYSTEM

TECHNICAL FIELD

This disclosure is generally directed to toner compositions, and methods for producing such toners, for use in forming and developing images of good quality. More specifically, this disclosure is directed to toner compositions containing a novel toner particle formulation and novel surface additive package, and methods for producing such compositions. Such compositions are useful, for example, as toners in single component development (SCD) systems.

BACKGROUND

Numerous processes are known for the preparation of toners, such as, for example, conventional processes wherein a resin is melt kneaded or extruded with a pigment, micronized, and pulverized to provide toner particles. Emulsion aggregation (EA) toners are used in forming print and/or xerographic images. Emulsion aggregation techniques typically involve the formation of an emulsion latex of resin particles that have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally with additional resin, is separately formed. The colorant dispersion is added to the emulsion latex mixture, and an aggregating agent or complexing agent is then added and/or aggregation is otherwise initiated to form aggregated toner particles. The aggregated toner particles are heated to enable coalescence/fusing, thereby achieving aggregated, fused toner particles.

Toner systems normally fall into two classes: two component development (TCD) systems, in which the developer material includes magnetic carrier granules having toner particles adhering triboelectrically thereto; and single component development (SCD) systems, which generally use only toner. Of the SCD systems, both magnetic and non-magnetic systems are known. Magnetic systems involve the use of a toner containing a magnetic substance, which may preclude the development of sharp color images, which has led to a focus on non-magnetic systems.

The operating latitude of a powder electrophotographic development system may be determined to a great degree by the ease with which toner particles may be supplied to an electrostatic image. Placing charge on the particles, to enable movement and development of images via electric fields, is often accomplished with triboelectricity. Triboelectric charging may occur either by mixing the toner with larger carrier beads in a TCD system, or by rubbing the toner between a blade and donor roll in an SCD system.

With non-magnetic SCD systems, toner is supplied from a toner house to the supply roll and then to the development roll. The toner is charged while it passes a charging/metering blade. Non-magnetic SCD has been very popular for desk top color laser printers due to its compact size, since it does not need a carrier in the development housing to charge toner. Non-magnetic SCD systems may thus utilize cartridges that are smaller in size compared with TCD systems, and the cost to a customer to replace a unit may, in some cases, be lower for a single component development system compared with a two component system.

There are several issues associated with SCD systems. The first is low charge and broad charge distribution on toner particles compared with conventional TCD toner. This is because the time for toner to flow through the gap between the blade and the development roll is very short. Low charge causes high background and low developability. Toner for SCD systems also has a high fines content, which may affect the charge and the print background. Also, the higher the fines content, the broader the charge distribution.

Another issue with SCD systems includes toner robustness in aging and in extreme environments such as A and C zone conditions found in an electro photographic apparatus. The high stress under the blade may cause the toner to stick to the blade or the development roll. This may reduce the toner charge and the toner flowability. Since non-magnetic toner is charged through a charging/metering blade, low charging and low flowability can cause print defects such as ghosting, white bands, and low toner density on images.

There remains a need for a toner composition suitable for high speed printing, particularly high speed monochrome printing that can provide excellent flow, charging, lower toner usage, and reduced drum contamination.

SUMMARY

This disclosure addresses some or all of the above problems, by providing new toner compositions including a novel additive package for generating developed images with, for example, high print quality on Single Component Development systems.

In one embodiment, a composition is provided having particles comprising a resin, an optional wax, a colorant, a surface additive comprising a mixture of: a hexamethyldisilazane (HMDS) surface treated silica, a sol-gel silica that is not surface treated, a polydimethylsiloxane (PDMS) surface treated silica, and an organic spacer comprising melamine and polymethylmethacrylate (PMMA).

In another embodiment, a composition is provided having particles comprising a resin, an optional wax, a colorant, a surface additive comprising a mixture of: a hexamethyldisilazane (HMDS) surface treated silica, wherein the HMDS surface treated silica has an average particle diameter of from about 30 to about 60 nm., a sol-gel silica that is not surface treated, wherein the sol-gel silica has an average particle diameter of from about 90 to about 200 nm., and a polydimethylsiloxane (PDMS) surface treated silica; wherein the PDMS silica has an average particle diameter of from about 30 to about 60 nm., and an organic spacer comprising melamine and polymethylmethacrylate (PMMA).

A method is also provided for making a composition, the method comprises forming a slurry of an emulsion containing a resin, a wax, and a colorant; heating the slurry to form aggregated particles in the slurry; freezing aggregation of the particles; heating the aggregated particles in the slurry to coalesce the particles into particles, washing and drying the particles; and coating the particles with a surface additive wherein the surface additive comprises a mixture of: a hexamethyldisilazane (HMDS) surface treated silica, a sol-gel silica that is not surface treated, a polydimethylsiloxane (PDMS) surface treated silica, and an organic spacer comprising melamine and PMMA.

BRIEF DESCRIPTION OF THE FIGURES

Various embodiments of the present disclosure will be described herein below with reference to the following figures wherein.

DETAILED DESCRIPTION

Figure 1:
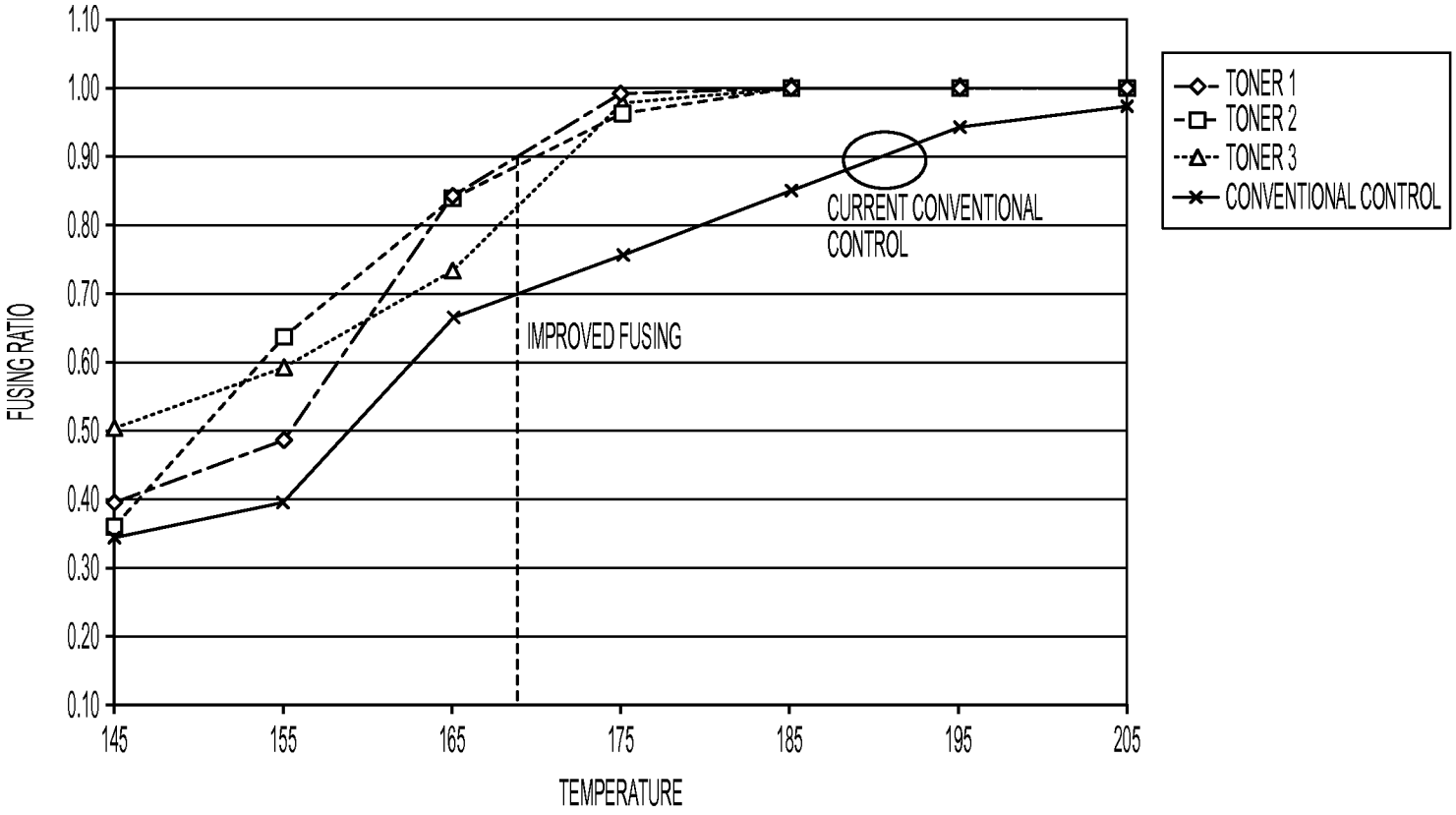
FIG. 1 is a comparison between exemplary toner formulations of this disclosure with a conventional toner formulation.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

The term "functional group" refers, for example, to a group of atoms arranged in a way that determines the chemical properties of the group and the molecule to which it is attached. Examples of functional groups include halogen atoms, hydroxyl groups, carboxylic acid groups, and the like.

The term "optional" or "optionally" refer, for example, to instances in which a subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs.

The present disclosure provides toners suitable for use in a single component development system which possesses excellent charging and flow characteristics. The toners of the present disclosure contain very large polymeric spacer additives as surface additives, optionally in combination with organic charge control agents as surface additives, which provide excellent flow characteristics to the resulting toners, and reduce the incidence of clogging failure and print defects such as ghosting, white bands, and low toner density compared with conventionally produced toners.

Toners of the present disclosure may include a latex resin in combination with a pigment and a wax. While the latex resin may be prepared by any method within the purview of those skilled in the art, in exemplary embodiments the latex resin may be prepared by emulsion polymerization methods, including semi-continuous emulsion polymerization, and the toner may include emulsion aggregation toners. Emulsion aggregation can involve aggregation of both submicron latex and pigment particles into toner size particles, where the growth in particle size is, for example, in exemplary embodiments from about 0.1 micron to about 15 microns.

For single component developers, i.e. developers that contain no charge carriers as in two component developers, it is desirable for the toner particles to exhibit high transfer efficiency, including excellent flow properties and functional cohesivity. The toners described herein as exemplary embodiments have appropriate compositions and physical properties to be suited for use in single component developer machines. These compositions and properties will be detailed below.

A toner is provided herein that may comprise a resin, a wax, and a colorant. A surface additive package can be added to the external surfaces of toner particles. That is, the toner particles may be first formed, followed by mixing of the toner particles with the materials of the additive package. The result can be that the additive package generally coats or adheres to external surfaces of the toner particles, rather than being incorporated into the bulk of the toner particles.

Resins and Polymers

Any monomer suitable for preparing a latex for use in a toner may be utilized. Such latexes may be produced by conventional methods. As noted above, in some exemplary embodiments, the toner may be produced by emulsion aggregation. Suitable monomers useful in forming a latex emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

As the toner (or binder) resin, any of the conventional toner resins can be used. Illustrative examples of suitable toner resins include, for example, thermoplastic resins such as vinyl resins in general or styrene resins in particular, and polyesters. Examples of suitable thermoplastic resins include styrene methacrylate; polyolefins; styrene acrylates, such as PSB-2700 obtained from Hercules-Sanyo Inc.; styrene butadienes; crosslinked styrene polymers; epoxies; polyurethanes; vinyl resins, including homopolymers or copolymers of two or more vinyl monomers; and polymeric esterification products of a dicarboxylic acid and a dial comprising a diphenol. Other suitable vinyl monomers include styrene; p-chlorostyrene unsaturated mono-olefins such as ethylene, propylene, butylene, isobutylene, and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile; methacrylonitrile; acrylamide; mixtures thereof; and the like. In addition, crosslinked resins, including polymers, copolymers, and homopolymers of styrene polymers, may be selected.

The latex polymer may include at least one polymer. Exemplary polymers include styrene acrylates, styrene butadienes, styrene methacrylates, and more specifically, poly (styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly (acrylonitrile-butyl acrylate-acrylic acid), and combinations thereof. The polymer may be block, random, or alternating copolymers.

In some embodiments, a poly(styrene-butyl acrylate) may be utilized as the latex. The glass transition temperature of this latex may be from about 50 to about 65° C., and in other embodiments from about 55 to about 60° C. In further embodiments, the glass transition temperature of the core latex can be from about 53 to about 57° C. and the glass transition temperature of the shell latex can be from about 50 to about 62° C.

Waxes

Wax dispersions may also be added during formation of a toner particle in an emulsion aggregation process according to exemplary embodiments. Suitable waxes include, for example, submicron wax particles in the size range of from about 50 to about 1000 nanometers, in other embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present, for example, in an amount of from about 0.1 to about 20% by weight, and in other embodiments of from about 1 to about 5% by weight of the wax. In further embodiments where a nonionic surfactant is used, the nonionic surfactant may be present, for example, in an amount of from about 0.1 to about 20% by weight and in further embodiments in an amount of from about 2 to about 3% by weight of the wax.

The wax dispersion according to exemplary embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite; wax emulsions available from Michelman Inc. and the Daniels Products Company; EPOLENE N-15 commercially available from Eastman Chemical Products, Inc.; VISCOL 550-P, a low weight average molecular weight polypropylene available from Sanyo Kasel K.; and similar materials. In some embodiments, commercially available polyethylene waxes possess a molecular weight (Mw) of from about 100 to about 5000, and in other embodiments of from about 250 to about 2500, while the commercially available polypropylene waxes have a molecular weight of from about 200 to about 10,000, and in further embodiments of from about 400 to about 5000.

In exemplary embodiments, the waxes may be functionalized. Examples of groups added to functionalize waxes include amines, amides, imides, esters, quaternary amines, and/or carboxylic acids. In other embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may, for example, be present in an amount of from about 0.1 to about 30% by weight, and in some embodiments from about 2 to about 20% of from about 4 to about 14% by weight of the toner.

In some embodiments, the wax is a paraffin wax. Suitable paraffin waxes include paraffin waxes possessing modified crystalline structures, which may be referred to herein as modified paraffin waxes. Compared with conventional paraffin waxes, which may have a symmetrical distribution of linear carbons and branched carbons, the modified paraffin waxes may possess branched carbons, for example, in an amount of from about 1 to about 20 wt % of the wax, such as from about 8 to about 16 wt % of the wax, with linear carbons present in an amount of from about 80 to about 99 wt % of the wax, or from about 84 to about 92 wt % of the wax.

In addition, the isomers, i.e., branched carbons, present in such modified paraffin waxes may have a number average molecular weight (Mn), for example, of from about 520 to about 600, such as from about 550 to about 570, or about 560. The linear carbons, sometimes referred to herein as normal, present in such waxes may have, for example, a Mn of from about 505 to about 530, such as from about 512 to about 525, or about 518. The weight average molecular weight (Mw) of the branched carbons in the modified paraffin waxes as measured by high flow Gas Permeation Chromatography analysis may be, for example, from about 530 to about 580, such as from about 555 to about 575, and the Mw of the linear carbons in the modified paraffin waxes as measured by high flow Gas Permeation Chromatography analysis may be, for example, from about 480 to about 550, such as from about 515 to about 535.

For the branched carbons, the weight average molecular weight (Mw) of the modified paraffin waxes may demonstrate a number of carbon atoms of, for example, from about 31 to about 59 carbon atoms, such as from about 34 to about 50 carbon atoms, with a peak at about 41 carbon atoms, and for the linear carbons, the Mw may demonstrate a number of carbon atoms, for example, from about 24 to about 54 carbon atoms, or from about 30 to about 50 carbon atoms, with a peak at about 36 carbon atoms.

The modified paraffin wax may be present in an amount of, for example, from about 2 wt % to about 20 wt % by weight of the toner, or from about 4 to about 15% by weight of the toner, or from about 5 to about 13% by weight of the toner.

Colorants

A colorant dispersion may be added to the latex particles and wax. In some exemplary embodiments, the colorant dispersion may include, for example, submicron colorant particles having a size of, for example, from about 50 to about 500 nanometers in volume average diameter and, in some embodiments, of from about 100 to about 400 nanometers in volume average diameter. The colorant particles may be suspended in an aqueous water phase containing an anionic surfactant, a nonionic surfactant, or combinations thereof. In various embodiments, the surfactant may be ionic and may be for example, from about 1 to about 25% by weight of the colorant, and in some embodiments from about 4 to about 15% by weight of the colorant.

Colorants that may be useful in forming toners in accordance with some embodiments may include pigments, mixtures of pigments and the like. The colorant may be, for example, carbon black, cyan, yellow, magenta, red, orange, brown, green, blue, violet, or combinations thereof.

In some exemplary embodiments, a pigment may be utilized. As used herein, a pigment includes a material that changes the color of light it reflects as the result of selective color absorption. A pigment is generally insoluble in the carrying vehicle.

In some exemplary embodiments, wherein the colorant is a pigment, the pigment may be, for example, carbon black, phthalocyanines, quinacridones, red, green, orange, brown, violet, yellow, fluorescent colorants including RHODAMINE B™ type, and the like.

Exemplary colorants may include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CBS600™, MCX6369™; Bayer magnetites including, BAYFERROX 8600™, 8610™; Northern Pigment magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710; CI Dispersed Red 15; diazo dye identified in the Color Index as CI 26050; CI Solvent Red 19; copper tetra(octadecyl sulfonamido) phthalocyanine; x-copper phthalocyanine pigment listed in the Color Index as CI 74160; CI Pigment Blue; Anthrathrene Blue identified in the Color Index as CI 69810; Special Blue X-2137; diarylide yellow 3,3-dichlorobenzidene acetoacetanilides; a monoazo pigment identified in the Color Index as CI 12700; CI Solvent Yellow 16; a nitrophenyl amine sulfonamide identified in the Color Index as Foron Yellow SE/GLN; CI Dispersed Yellow 33; 2,5-dimethoxy-4-sulfonamide phenylazo-4'-chloro-2,5-dimethoxy acetoacetanilide; Yellow 180; and Permanent Yellow FGL. Organic soluble dyes having a high purity for the purpose of color gamut which may be utilized include Neopen Yellow 075; Neopen Yellow 159; Neopen Orange 252; Neopen Red 336; Neopen Red 335; Neopen Red 366; Neopen Blue 808; Neopen Black X53; Neopen Black X55; and combinations of any of the foregoing, and the like.

In various embodiments, colorant examples include Pigment Blue 15:3 having a Color Index Constitution Number of 74160; Magenta Pigment Red 81:3 having a Color Index Constitution Number of 45160:3; Yellow 17 having a Color Index Constitution Number of 21105; and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

The colorant, such as carbon black, cyan, magenta, and/or yellow colorant, can be incorporated in an amount sufficient to impart the desired color to the toner. In general, a pigment can be employed in an amount ranging, for example, from about 1 to about 35 wt % of the toner particles on a solids basis, or from about 5 to about 25 wt %, or from about 5 to about 15 wt % of the toner particles on a solids basis. However, amounts outside these ranges can also be used.

Coagulants

In certain embodiments, a coagulant may be added during or prior to aggregating the latex and the colorant dispersion. The coagulant may be added over a period of time from about 1 to about 60 minutes, and in other embodiments from about 1.25 to about 20 minutes, depending on the processing conditions.

Examples of suitable coagulants include polyaluminum halides such as polyaluminum chloride (PAC), or the corresponding bromide, fluoride, or iodide; polyaluminum silicates such as polyaluminum sulfo silicate (PASS); and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. Generally, PAC can be prepared by the addition of two moles of a base to one mole of aluminum chloride. The species is soluble and stable when dissolved and stored under acidic conditions if the pH is less than about 5.

The polymetal salt can be in a solution of nitric acid, or other diluted acid solutions such as sulfuric acid, hydrochloric acid, citric acid or acetic acid. The coagulant may be added in amounts, for example, from about 0.01 to about 5% by weight of the toner, and in some embodiments from about 0.1 to about 3 and from about 0.12 to about 0.2% by weight of the toner. In exemplary embodiments, PAC may be added in amounts, for example, from about 0.12 to about 20% by weight of the toner.

Surfactants

Colorants, waxes, and other additives used to form exemplary embodiments of toner compositions may be in dispersions that can include surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

In various embodiments, the latex may be prepared in an aqueous phase containing a surfactant or co-surfactant. Surfactants which may be utilized with the polymer to form a latex dispersion can be ionic or nonionic surfactants in an amount to provide a dispersion of, for example, from about 0.01 to about 15 wt % solids, and in some embodiments of from about 0.1 to about 5 wt % solids.

Anionic surfactants which may be utilized in some embodiments include sulfates and sulfonates; sodium dodecylsulfate (SDS); sodium dodecylbenzene sulfonate; sodium dodecylnaphthalene sulfate; dialkyl benzene alkyl sulfates and sulfonates; acids such as abiotic acid available from Aldrich, NEOGEN®; NEOGEN SC™ obtained from Daiichi Kogyo Seiyaku Co., Ltd.; DOWFAX™ obtained from Dow Chemical; combinations thereof; and the like.

Examples of cationic surfactants can include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, combinations thereof, and the like. Other cationic surfactants can include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride) available from Kao Chemicals, combinations thereof, and the like. In certain embodiments, a suitable cationic surfactant includes SANISOL B-50 available from Kao Corp., which is primarily a benzyl dimethyl alkonium chloride.

Examples of nonionic surfactants can include, but are not limited to, alcohols, acids and ethers, for example: polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In various embodiments, commercially available surfactants from Rhone-Poulenc such as IGEPAL CA-210™; IGEPAL CA-520™; IGEPAL CA-720™; IGEPAL CO-890™; IGEPAL CO-720™; IGEPAL CO-290™; IGEPAL CA-210™; ANTAROX 890™, and ANTAROX 897™ can be utilized.

Particular surfactants or combinations thereof, as well as the amounts of each to be used, are within the purview of those skilled in the art.

Initiators

In exemplary embodiments, initiators may be added for formation of the latex polymer. Examples of suitable initiators can include water soluble initiators, such as ammonium per sulfate, sodium per sulfate and potassium per sulfate; and organic soluble initiators including organic peroxides and azo compounds including Vazo peroxides, such as VAZO 64™, 2-methyl 2-2'-azobis propanenitrile, VAZO 88™; 2-2'-azobis isobutyramide dehydrate; and combinations thereof. Other water-soluble initiators which may be utilized include azoamidine compounds, for example, 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators can be added to the latex in suitable amounts, such as from about 0.1 to about 8 wt % of the monomers, and in certain embodiments of from about 0.2 to about 5 wt % of the monomers.

Chain Transfer Agents

In some embodiments, chain transfer agents may also be utilized in forming the latex polymer. Suitable chain transfer agents include dodecane thiol, octane thiol, carbon tetrabromide, combinations thereof, and the like, in amounts, for example, from about 0.1 to about 10% by weight of the monomers, and, in certain embodiments, from about 0.2 to about 5% by weight of monomers, to control the molecular weight properties of the latex polymer.

Secondary Latex

In exemplary embodiments, a secondary latex may be added to the non-cross-linked latex resin suspended in the surfactant. As used herein a secondary latex may refer to, in some embodiments, a cross-linked resin or polymer, or mixtures thereof, or a non-cross-linked resin as described above, that has been subjected to crosslinking.

The secondary latex may include submicron cross-linked resin particles having a size of from about 10 to about 300 nanometers in volume average diameter, in some embodiments from about 20 to 250 nanometers in volume average diameter. The secondary latex may be suspended in an aqueous phase of water containing a surfactant, wherein the surfactant can be in an amount from about 0.3 about 10% by weight of total solids, or from about 0.7 to about 5% by weight of total solids.

The cross-linked resin may be a cross-linked polymer such as cross-linked styrene acrylates, styrene butadienes, and/or styrene methacrylates. In particular, exemplary cross-linked resins are cross-linked poly(styrene-alkyl acrylate), poly(styrene-butadiene), poly(styrene-isoprene), poly(styrene-alkyl methacrylate), poly(styrene-alkyl acrylate-acrylic acid), poly (styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly (alkyl acrylate-acrylonitrile-acrylic acid), and mixtures thereof.

A cross linker, such as divinyl benzene or other divinyl aromatic or divinyl acrylate or methacrylate monomers, may be used in the crosslinked resin. The cross-linker may be present in an amount of from about 0.01 to about 25% by weight of the cross-linked resin, or from about 0.5 to about 20% by weight of the cross-linked resin.

The cross-linked resin particles may be present in an amount of from about 1 to about 20% by weight of the toner, in some embodiments from about 4 to about 15% by weight of the toner, and in other embodiments from about 5 to about 14% by weight of the toner.

In some embodiments, the resin utilized to form the toner may be a mixture of a gel resin and a non-crosslinked resin.

Stabilizers

In some embodiments, it may be advantageous to include a stabilizer when forming the latex particles. Suitable stabilizers include monomers having carboxylic acid functionality. Such stabilizers may be of formula (1):

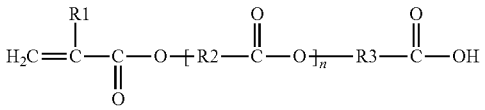

(I)

wherein R1 is hydrogen or a methyl group; R2 and R3 are independently selected from alkyl groups containing from about 1 to about 12 carbon atoms or a phenyl group; n is from about 0 to about 20, in some embodiments from about 1 to about 10. Examples of such stabilizers include beta carboxyethyl acrylate (.beta.-CEA), poly(2-carboxyethyl) acrylate, 2-carboxyethyl methacrylate, combinations thereof, and the like. Other stabilizers which may be utilized include, for example, acrylic acid and its derivatives. In some embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10% by weight of the stabilizer having carboxylic acid functionality, in some embodiments from about 0.5 to about 5% by weight of the stabilizer having carboxylic acid functionality.

Where present, the stabilizer may be added in amounts from about 0.01 to about 5% by weight of the toner, and in some embodiments from about 0.05 to about 2% by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In some embodiments a stabilizer may include a composition containing sodium silicate dissolved in sodium hydroxide.

Shell

In various embodiments, a shell may be formed on the aggregated particles. Any latex noted above used to form the core latex may be used to form the shell latex. In some embodiments, a styrene-n-butyl acrylate copolymer is used to form the shell latex. The shell latex may have a glass transition temperature of from about 50 to about 65° C., and in some embodiments of from about 55 to about 60° C. or from about 56 to about 59° C.

Where present, a shell may be applied by any method within the purview of those skilled in the art, including dipping, spraying, and the like. The shell may be applied until the desired final size of the toner particles is achieved, such as from about 3 to about 12 microns, or from about 4 microns to about 9 microns. The shell may be prepared by in-situ seeded semi-continuous emulsion copolymerization of the latex and the shell can be added once aggregated particles have formed.

Where present, the shell may be present in an amount of from about 20 to about 50 wt % of the dry toner particle, and in other embodiments of from about 26 to about 40 wt %, or from about 28 to about 34 wt % of the dry toner particle. The thickness of the shell may be of from about 100 to about 1500 nm, or in some embodiments from about 200 to about 800 nm, or from about 300 to about 600 nm.

Surface Additive Package

In certain embodiments, a surface additive package may be applied to the toner particles. The additive package may generally coat or adhere to external surfaces of the toner particles, rather than being incorporated into the bulk of the toner particles. The components of the additive package may be selected to enable superior flow properties, high toner charge, charge stability, dense images, and low drum contamination.

In some embodiments, the surface additive package may comprise a first silica. The first silica can be surface treated with hexamethyldisilazane (HMDS). The HMDS silica may have a volume average diameter of from about 5 to about 75 nm, or in some embodiments from about 10 to about 70 nm, or from about 3 to about 60 nm.

The HMDS surface treated silica may be present in an amount of from about 0.05 to about 2 wt % of the particle, or in some embodiments, from about 0.4 to about 2 wt % of the particle, or from about 0.25 to about 1.8 wt % of the particle, or from about 0.3 to about 1.4 wt % of the particle, or from about 0.50 to about 1.3 wt % of the particle, or from about 0.5 to about 0.6 wt % of the particle.

In some embodiments, the surface additive package may comprise a second silica. The second silica may be a sol gel silica. The second silica may have a volume average diameter of from about 90 to about 200 nm, or in some embodiments from about 100 to about 150 nm, or from about 140 to about 180 nm, or from about 120 to about 150 nm.

The sol-gel silica may be present in an amount of from about 0.10 to about 1.00 wt % of the particle, or in some embodiments from about 0.30 to about 0.90 wt % of the particle, or from about 0.40 to about 0.80 wt % of the particle, or from about 0.45 to about 0.65 wt % of the particle.

For some embodiments, the surface additive package may further comprise a third silica. The third silica can be surface treated with polydimethylsiloxane (PDMS). The PDMS silica may have a volume average diameter of from about 5 to about 75 nm, or in some embodiments from about 10 to about 70 nm, or from about 30 to about 60 nm.

The PDMS silica may be present in an amount of from about 0.10 to about 3 wt % of the particle, or in some embodiments from about 1 to about 3 wt %, from about 0.30 to about 2.75 wt %, or from about 0.40 to about 2.7 wt %, or from about 2.45 to about 2.65 wt %, or from about 0.5 to about 2.55 wt % or the particle.

According to exemplary embodiments, the weight ratio of the HMDS surface treated silica to the sol-gel silica may be in a range of from about 0.45:0.06 to about 0.75:0.25, and in other embodiments, from about 0.5:0.1 to about 0.6:0.2.

The weight ratio of the HMDS surface treated silica to the PDMS surface treated silica may be in a range of from about 0.45:2.4 to about 0.75:2.7, and in other embodiments, from about 0.5:2.45 to about 0.6:2.65.

The weight ratio of the HMDS surface treated silica to the sol-gel and the PDMS surface treated silica may be in a range of from about 0.45:0.05:2.3 to about 0.75:0.25:2.7, and in some embodiments, from about 0.5:0.1:2.45 to about 0.6:0.2:2.65, or from about 0.45:0.15:2.35 to about 0.55:0.25:2.45.

In exemplary embodiments, the external surface additive package may be present in an amount from about 2 to about 5% by weight of the toner particle, or from about 3.05 to about 4.45%, or from about 3.55 to about 4.25% by weight of the particle. The total additives package may be in the range of from about 2 to about 4% by weight of the toner, or from about 2.55% to about 4.05%, or from about 3.25 to about 3.95% by weight of the toner. The total of the different silicas in the surface additive package may be about 1.5 to about 3.5% by weight of the toner, or from about 2 to about 3.4%, or from about 2.3 to about 3.3% by weight of the toner.

In certain embodiments, the external surface additive may include spacer molecules added thereto as a surface additive. For example, large polymeric surface additives may be included with a toner composition of the present disclosure as a spacer to prevent toner particles sticking to the development roll, thereby reducing the incidence of print defects such as ghosting, white bands, and low toner density on images. As used herein, large polymeric surface additives, also referred to herein, in some embodiments, as large polymeric spacers, may have a volume average diameter of from about 300 nm to about 800 nm, or in some embodiments from about 600 nm to about 700 nm.

Suitable large polymeric spacers include, in some embodiments, polymers such as polystyrenes, fluorocarbons, polyurethanes, polyolefins including high molecular weight polymethylenes, high molecular weight polyethylenes, and high molecular weight polypropylenes, and polyesters including acrylates, methacrylates, methyl methacrylates, and combinations thereof. Specific large polymeric spacers which may be utilized include polymethyl methacrylate, styrene acrylates, polystyrene, fluorinated methacrylates, fluorinated polymethyl methacrylates, and combinations thereof.

Large polymeric spacers may be added so that they are present in an amount of from about 0.1 to about 1% by weight of the toner particles, in some embodiments from about 0.25 to about 0.85% by weight of the toner particles, or from about 0.35 to about 0.65% by weight of the toner particles.

In some embodiments, the large polymeric spacers may be subjected to surface treatments. Such treatments include, for example, the application of silicon, zinc, combinations thereof, and the like, to the large polymeric spacer particles. In some embodiments, silicon and zinc may be combined and added to the surface of a large polymeric spacer with the silicon present in an amount of from about 40 to about 120 ppm, or in some embodiments from about 90 to about 100 ppm, and the zinc may be present in an amount of from about 1200 to about 4000 ppm, or in some embodiments from about 2700 to about 3000 ppm. The ratio of silicon to zinc may thus be from about 1:2 to about 1:8, or in some embodiments from about 1:3 to about 1:5.

Other suitable surface treatments for the large polymeric spacer include coatings such as silicone oils, siloxanes including polydimethylsiloxane, octamethylcyclotetrasiloxane, silanes including—.gamma.-amino tri-methoxy silane, and dimethyldichlorosilane (DDS), silazanes including hexamethyldisilazane (HMDS), other silicon compounds such as dimethyloctadecyl-3-trimethoxy (silyl) propyl ammonium chloride, as well as metal salicylates utilizing metals such as iron, zinc, aluminum, magnesium, and combinations thereof.

Large polymeric spacers may be combined with toner particles utilizing any method within the purview of those skilled in the art, including blending, mixing, roll milling, combinations thereof, and the like, so that the large polymeric spacers may become attached to the surface of the toner particles. In some embodiments, large polymeric spacers may be combined with toner particles by mixing at a speed of from about 800 to about 3800 rpm, or in some embodiments from about 1400 to about 3200 rpm, for a period of time of from about 5 to about 25 minutes, or in some embodiments from about 7 to about 15 minutes.

The resulting particles with spacers may possess a surface area of from about 0.70 to about 1.5 m2/g, in some embodiments from about 0.90 to about 1.3 m2/g, or from about 0.8 to about 1.2 m2/g as determined by the Brunauer, Emmett and Teller (BET) method.

Other Additives

In addition to the surface additive package described above, further optional additives may be combined with the toner according to certain embodiments. These include any additive to enhance the properties of toner compositions. For example, the toner may include positive or negative charge control agents in an amount, for example, of from about 0.1 to about 10% by weight of the toner, or in some embodiments from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; metal salicylates combinations thereof, and the like.

Other included additives may include an organic spacer, such as polymethylmethacrylate (PMMA). The organic spacer may have a volume average diameter of from about 300 to about 600 nm, or in some embodiments, from about 300 to about 400 nm, or from about 350 to about 450 nm.

Other included additives may include an organic spacer, such as melamine. The organic spacer may have a volume average diameter of from about 200 to about 800 nm, or in some embodiments, from about 300 to about 600 nm, or from about 350 to about 450 nm.

In different embodiments, the size of the additives utilized may vary. Thus, in some embodiments, an additive utilized in addition to the large polymeric spacer described above may have a volume average diameter of from about 5 to about 600 nm, depending upon the additive. For example, small silica may have a volume average diameter of from about 5 to about 20 nm; medium silica may have a volume average diameter of from about 30 to about 50 nm; large silica may have a volume average diameter of from about 60 to about 180 nm; small titania may have a volume average diameter of from about 10 to about 30 nm; medium titania may have a volume average diameter of from about 40 to about 70 nm; large titania may have a volume average diameter of from about 80 to about 150 nm; aluminum oxide may have a volume average diameter of from about 13 to about 100 nm; cerium oxide may have a volume average diameter of from about 300 to about 600 nm; and strontium titanate may have a volume average diameter of from about 50 to about 200 nm.

Where additional additives are utilized in addition to the large polymeric spacer, the large polymeric spacer may be present in an amount from about 0.05 to about 1% by weight of the toner, or in some embodiments from about 0.1 to about 0.5% by weight of the toner, while the second additive may be present in an amount from about 0.05 to about 0.8% by weight of the toner, or in some embodiments from about 0.1 to about 0.3% by weight of the toner. In certain embodiments, third or more additives may be included, for example titanium dioxide for control of relative humidity characteristics, in an amount of from about 0.01 to about 0.3% by weight of the toner, or in some embodiments from about 0.05 to about 0.15% by weight of the toner. Other additives may also be used in the blend depending upon the desired performance and hardware interactions.

Other optional additives may include surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives may each be present in an amount of from about 0.1 to about 10% by weight of the toner, such as from about 0.5 to about 7% by weight of the toner. Examples of such additives include, for example, those disclosed in U.S. Pat. Nos. 3,590,000, 3,720,617, 3,655,374, and 3,983,045, the disclosures of each of which are hereby incorporated by reference in their entirety. The coated silicas of U.S. Pat. No. 6,190,815 and U.S. Pat. No. 6,004,714, the disclosures of each of which are hereby incorporated by reference in their entirety, can also be selected in amounts, for example, from about 0.05 to about 5% by weight of the toner, and in some embodiments of from about 0.1 to about 2% by weight of the toner. These additives may be added during the aggregation or blended into the formed toner product.

The above surface additives may be utilized to optimize charging and charge distribution of a toner. For example, the large polymeric spacers herein may act as a spacer to prevent toner sticking to the development roll, thereby reducing the incidence of print defects such as ghosting, white bands, and low toner density on images.

In various embodiments, the blending of large polymeric spacers, optionally in combination with other additives, may impart triboelectric charges to the toner. Exemplary toners of the present disclosure may thus have a triboelectric charge in the A zone at from about 20 to about 60 μC/g, or in some embodiments at from about 30 to about 50 μC/g; in the B zone, at from about 40 to about 100 μC/g, or in some embodiments at from about 50 to about 90 μC/g; and in the J zone at from about 60 to about 120 μC/g, or in some embodiments at from about 70 to about 100 μC/g.

As the charging of the toner particles may be enhanced, less surface additives may be required in various embodiments, and the final toner charging may thus be higher to meet machine charging requirements.

Aggregating Agents

Any aggregating agent capable of causing complexation might be used in forming exemplary toners of the present disclosure. Both alkali earth metal or transition metal salts can be utilized as aggregating agents. In some embodiments, alkali (II) salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

pH Adjustment Agent

A pH adjustment agent may be added to control the rate of the emulsion aggregation process and the coalescence process. The pH adjustment agent may be any acid or base that does not adversely affect the products being produced. Suitable bases include metal hydroxides, such as sodium hydroxide, potassium hydroxide, ammonium hydroxide, and combinations thereof. Suitable acids include nitric acid, sulfuric acid, hydrochloric acid, citric acid, acetic acid, and combinations thereof.

Once the desired final size of the toner particles is achieved, the pH of the mixture may be adjusted with a base to a value of from about 3.5 to about 7, or in some embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30% by weight of the mixture, in some embodiments from about 0.5 to about 15% by weight of the mixture.

Methods

According to various embodiments, emulsion aggregation procedures typically include the basic process steps of mixing together an emulsion containing a polymer or a resin, optionally one or more waxes, optionally one or more colorants, optionally one or more surfactants, an optional coagulant, and one or more additional optional additives to form a slurry; heating the slurry to form aggregated particles in the slurry; optionally adding the shell and freezing aggregation of the particles by adjusting the pH; and heating the aggregated particles in the slurry to coalesce the particles into toner particles; and then recovering, optionally washing, and optionally drying the obtained emulsion aggregation toner particles. The reactants may be added to a suitable reactor, such as a mixing vessel. The appropriate amount of the components may be combined in the reactor and the emulsion aggregation process may be allowed to begin. Reaction conditions selected for effecting the emulsion polymerization include temperatures of, for example, from about 45 to about 120° C., or in some embodiments from about 60 to about 90° C. In exemplary embodiments the polymerization may occur at elevated temperatures within about 10 of the melting point of any wax present, for example from about 60 to about 85° C., or in some embodiments from about 65 to about 80° C., to permit the wax to soften thereby promoting dispersion and incorporation into the emulsion.

Exemplary toners of the present disclosure may be prepared by combining a latex polymer, a wax, and a colorant in the aggregation process followed by the coalescence process, washing and drying and then blending with external surface additives.

The latex polymer may be prepared by any method within the purview of those skilled in the art. One way the latex polymer may be prepared is by emulsion polymerization methods, including semi-continuous emulsion polymerization. The resultant blend of latex, optionally in a dispersion, stabilizer, wax, colorant dispersion, coagulant, and aggregating agent, may then be stirred and heated to a temperature below the Tg of the latex, in some embodiments from about 30 to about 70° C., or in some embodiments of from about 35 to about 65° C., for a period of time of from about 0.2 to about 6 hours, or in some embodiments from about 0.3 to about 5 hours, to form toner aggregates of from about 2 to about 10 microns in volume average diameter, or in some embodiments of from about 4 to about 9 microns in volume average diameter, or from about 6 to about 8 microns.

The aggregated particles are subsequently coalesced, according to certain embodiments. Coalescing may include stirring and heating at a temperature of from about 80 to about 99° C. for a period of from about 0.5 to about 12 hours, or in some embodiments from about 1 to about 6 hours. Coalescing may be accelerated by additionally adjusting the pH to a more acidic level.

In different embodiments, the pH of the mixture may then be lowered to from about 3.5 to about 6 and, or some embodiments, to from about 3.7 to about 5.5 with, for example, an acid, to further coalesce the toner aggregates. Suitable acids include, for example, nitric acid, sulfuric acid, hydrochloric acid, citric acid and/or acetic acid. The amount of acid added may be from about 0.1 to about 30% by weight of the mixture, and in some embodiments from about 1 to about 20% by weight of the mixture.

The mixture may be cooled, washed and dried. In accordance with certain embodiments, cooling may be at a temperature of from about 20 to about 65° C., or in some embodiments from about 22 to about 50° C., over a period of time of from about 0.5 to about 8 hours, or in some embodiments from about 1.5 to about 5 hours.

The toner slurry may then be washed. In certain embodiments, the washing may be carried out at a pH of from about 7 to about 12, or in some embodiments at a pH of from about 8 to about 11. The washing may be at a temperature of from about 25 to about 70° C., or in some embodiments from about 30 to about 55° C. The washing may include filtering and reslurrying a filter cake including toner particles in deionized water. The filter cake may be washed one or more times by deionized water, or washed by a single deionized water wash wherein the pH of the slurry is adjusted with an acid, and followed optionally by one or more deionized water washes.

In certain embodiments, drying may be carried out at a temperature of from about 35 to about 75° C., or in some embodiments of from about 45 to about 60° C. The drying may be continued until the moisture level of the particles is below a set target of about 1% by weight, or in some embodiments of less than about 0.7% by weight.

Toner Properties

Emulsion aggregation processes provide greater control over the distribution of toner particle sizes by limiting the amount of both fine and coarse toner particles in the toner as compared to conventional pulverization methods. In some embodiments, the toner particles have a relatively narrow particle size distribution with a lower number ratio geometric standard deviation (GSDn) of about 1.15 to about 1.40, such as from about 1.16 to about 1.25, or from about. 1.17 to about 1.23, as compared to conventional pulverized toner, ranging from 1.25 to about 1.55. The toner particles may also exhibit an upper geometric standard deviation by volume (GSDv) in the range of from about 1.15 to about 1.35, such as from about 1.15 to about 1.21, or from about 1.18 to about 1.30 as compared to conventional pulverized toner, ranging from 1.25 to about 1.45.

The toner particles in exemplary embodiments may have a volume average diameter (also referred to as "volume average particle diameter" or "$D_{50v}$,") of from about 3 to about 25 μm, such as from about 4 to about 15 μm, or from about 5 to about 12 μm, or from about 6.5 to about 8 μm., $D_{50v}$, GSDv, and GSDn may be determined using a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

By optimizing the particle size and circularity of the particles as illustrated herein, exemplary toners of the present disclosure may be may be suited for higher speed printing on single component development (SCD) systems and optimized machine performance.

Exemplary toner particles may have a circularity of about 0.920 to about 0.999, or in some embodiments, from about 0.940 to about 0.980, or from about 0.950 to about 0.998, or from about 0.970 to about 0.995, or from about 0.962 to about 0.980, from about greater than or equal to 0.982 to about 0.999, or from about greater than or equal to 0.950 to about 0.965. A circularity of 1.000 indicates a completely circular sphere. Circularity may be measured with, for example, a Sysmex FPIA 2100 or 3000 analyzer.

Some exemplary toner particles may have a surface area of from about 0.5 to about 1.6 $m^2/g$, or some embodiments from about 0.8 to about 1.4 $m^2/g$, or from about 0.6 to about 1.2 $m^2/g$, or from about 0.7 to about 1.1 $m^2/g$. The surface area may be determined by the Brunauer, Emmett, and Teller (BET) method.

Other exemplary toner particles may have a weight average molecular weight (Mw) in the range of from about 2,500 to about 65,000 daltons, a number average molecular weight (Mn) of from about 1,500 to about 28,000 daltons, and an MWD (a ratio of the Mw to Mn of the toner particles, a measure of the polydispersity, or width, of the polymer) of from about 1.2 to about 10. For cyan and yellow toners, the toner particles may exhibit an Mw of from about 2,500 to about 65,000 daltons, an Mn of from about 1,500 to about 28,000 daltons, and a MWD of from about 1.2 to about 10. For black and magenta, the toner particles may exhibit an Mw of from about 2,500 to about 60,000 daltons, an Mn of from about 1,500 to about 28,000 daltons, and an MWD of from about 1.2 to about 10.

The characteristics of the toner particles may be determined by any suitable technique and apparatus and are not limited to the instruments and techniques indicated herein above.

Further, the toners, if desired, may have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values (Mp) for the binder, which represents the highest peak of the Mw. In the present disclosure, the binder may have Mp values in the range of from about 5,000 to about 50,000 daltons, such as from about 7,500 to about 45,000 daltons. The toner particles prepared from the binder may exhibit a high molecular peak, for example, of from about 5,000 to about 43,000, or in some embodiments from about 7,500 to about 40,500 daltons, which may indicate that the molecular peak is driven by the properties of the binder rather than another component such as the colorant.

Toners of the present disclosure have excellent properties low minimum fix temperature (MFT), and high density. For example, the toners may possess low minimum fix temperatures, i.e., temperatures at which images produced with the toner may become fixed to a substrate, of from about 135 to about 220° C., or in some embodiments from about 155 to about 220° C., or from about 185 to about 210° C. The toners may have a fusing percentage of from about 50 to about 100%, or in some embodiments from about 60 to about 95%, or from about 80 to about 90%. The fusing percentage of an image may be evaluated in the following manner. The toner is fused from low to high temperatures depending upon initial set point. Toner adherence to paper is measured by tape removal of the areas of interest with subsequent density measurement. The density of the tested area is divided by the density of the area before removal then multiplied by 100 to obtain percent fused. The optical density is measured with a spectrometer (for example, a 938 Spectrodensitometer, manufactured by X-Rite). Then, the optical densities thus determined are used to calculate the fusing ratio according to the following Equation.

$$\text{Fusing}(\%)=(\text{Area after removal}/\text{Area before removal})\times 100$$

The toners may also possess excellent charging characteristics when exposed to extreme relative humidity (RH) conditions. The low-humidity zone may be about 12° C./15% RH, while the high humidity zone may be about 28° C./85% RH. Toners of the present disclosure may possess a parent toner charge per mass ratio (Q/M) of from about −2 to about −50 mμC/g, or in some embodiments from about −4 to about −35 mμC/g, and a final toner charging after surface additive blending of from −8 to about −40 mμC/g, or in some embodiments from about −10 to about −25 mμC/g.

The toners may exhibit a hot offset temperature of, for example, from about 190 to about 210° C., or in some embodiments from about 200 to about 210° C., or from about 205 to about 210° C.

The toner compositions may have a flow, measured by Hosakawa Powder Flow Tester. Toners of the present disclosure may exhibit a flow of from about 35 to about 65%, or in some embodiments from about 30 to about 40%.

The toner composition may be measured for compressibility, which is partly a function of flow. Toners of the present disclosure may exhibit a compressibility of from about 8 to about 15%, or in some embodiments from about 10 to about 12% at 9.5-10.5 kPa.

The drum contamination after using the toner compositions may be measured by removing the drum and subsequently weighing. Toners of the present disclosure may exhibit a drum contamination following 0-999 prints or from about 0 to about 20%, or in some embodiments of from about 1 to about 8%.

The density of the toner compositions may be measured by densitometer. Toners of the present disclosure may exhibit a density of from about 1.10 to about 1.65, or in some embodiments from about 1.4 to about 1.6.

Uses

Toners in accordance with the present disclosure may be used, for example, in SCD monochrome printers. Toners of the present disclosure may process improved hot offset and fusing ratio performance and high optical density of the printed images as compared to conventional pulverized toner.

The following Examples are illustrate exemplary embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Toners in accordance with the present disclosure are comprised of a three latex system consisting of a low Tg core, higher Tg shell latex and latex gel for optimal gloss, release time and dwell time in the fuser. Particles have a size range of from about 7.0 to about 8.0 μm and a shape range of from about 0.955 to about 0.965. The characteristics of the toner particles contribute to an improvement in clearing drum fog, morning drum fog in high heat/humidity (80/80), release, dwell time in fuser and print acuity when used on high speed SCD systems, for example and without limitation 55 to 65 ppm SCD systems. Table 1 below lists the formulations of the specific particle components.

The formulations of Table 1 were prepared using a 10 liter Henschel blender by blending toner particles prepared by the aggregation process with external additives. The toner particles were prepared according to the formulation summarized in Table 1. Water was added so that the reactor had a solids content of about 14%. The latex and wax was optimized to avoid issues in hot offset and minimum fusing. The target properties of the toner are a median volume of the dry particle of about 6.8 to 7.4 μm and a circularity of from about 0.950 to about 0.980. Emulsion aggregation toner particles were prepared in a batch process.

The resin core, pigment (colorants being Cyan 15:3 Pigment and Regal 330 carbon black), paraffin wax, and polyaluminum chloride (PAC 100) (or other coagulating agent). were first homogenized for about 20 to 90 minutes, then mixed at about 30° C. After homogenization, the mixture was pulled out of the homogenizer loop and was mixed in the reactor at control speed and set temperature. Particles in the mixture were grown to the desired size of about 5.4-5.8 um (please provide). The shell was then added until the appropriate particle size was reached of from about 6.4 to about 6.8 μm, and then growth was halted with the addition of a base such as sodium hydroxide and adjusted to pH of about 5.5 to 5.7. The temperature was raised to 96° C. Ramp to coalesce was carefully watched and at 80° C., the pH was adjusted to about 5 to 5.2. The particles were then coalesced at a a coalescence temperature of about 96° C. The batch was monitored for particle circularity (measured using the Malvem Sysmex FPIA e3000) keeping 0.965 as the maximum level of circularity. Once the particle circularity was 0.960, the pH was adjusted to about 6.9. The temperature of the reactor was then set to 63° C. and the slurry cooled at the rate of 0.6 C/min. At this temperature, the pH was adjusted to about 8.8. Once the slurry reached this pH, the temperature was lowered to about 40° C. The slurry was discharged and the particles were then wet sieved, washed by filtration, and freeze-dried.

The resulting particles were then taken and blended as toner with the addition of a large polymeric spacer including a polymethyl methacrylate (PMMA Spacer) having a size of about 500 nm and Melamine (Epostar Spacer) having a size of about 300 nm commercially available as ESPRIX 1451 from Esprix technologies. Three silicas were added including medium silica (40 nm polydimethyl siloxane (PDMS)), colloidal silica (100 nm coating) and medium silica (40 nm hexamethyldisilazane (HMDS).

Toner formulations were prepared with the compositions as shown in Table 1 The toner particles had a MW of from about 30 to about 35 kpse, an Mn of from about 10 to about 15 kpse and an MWD of from about 1.5 to about 4.5.

TABLE 1

| Component | Toner 1 | Toner 2 | Toner 3 |
|---|---|---|---|
| Latex Core % range | 46-49 | 46-49 | 46-49 |
| Latex Shell % range | 26-29 | 26-29 | 26-29 |
| Latex Gel % range | 7.5-8.5 | 7.5-8.5 | 7.5-8.5 |
| Paraffin Wax % range | 5-15 | 5-15 | 5-15 |
| Colorant 1 Regal 330 Carbon Black % range | 3-10 | 3-10 | 3-10 |
| Colorant 2 Cyan 15:3 % range | 0.1-3 | 0.1-3 | 0.1-3 |
| Coagulant PAC-100 Pph | 0.13-0.2 | 0.13-0.2 | 0.13-0.2 |
| Silica 1 40 nm PDMS % range | 2-3 | 2-3 | 2-3 |
| Silica 2 100 nm Colloidal % range | 0.05-0.3 | 0.1-0.2 | 0.1-0.2 |
| Silica 3 40 nm HMDS % range | 0.35-0.65 | 0.45-0.65 | 0.45-0.65 |
| Spacer 1 Melamine (Epostar) % range | 0.01-0.15 | 0.05-0.15 | 0.05-0.15 |
| Spacer 2 PMMA % range | 0.3-0.7 | 0.45-0.65 | 0.25-0.65 |

The toner formulations of Table 1 were tested at ambient and low relative humidity (RH) conditions, continuous print cycle out, in a 55 ppm high speed SCD machine, using refill cartridges that included the above toners after initial usage having only silica as surface additive were tested under the same conditions as a control.

Testing Conditions

The toner formulations were tested at two extreme printing conditions. First, cold and dry printing conditions; and second, warm and humid printing conditions. It is desirable that toners and developers be functional under a broad range of environmental conditions to enable good image quality from a printer. Thus, it is desirable for toners and developers to function at low humidity and low temperature, for example at 50° F. and 20% relative humidity and high humidity and temperature, for example at 80° F. and 80-85% relative humidity.

Fusing was also tested for the toner formulation. FIG. 1 is a comparison of Toners 1, 2 and 3 against a conventional control. The fusing ratio is at 0.9 or 90% at about 169° C. versus about 191° C. for conventional toner. These results demonstrate that the toners of the disclosure are lower melting with better adhesion to plain paper.

The results in Table 2 demonstrate that even at lower melt, the HOT offset is greater than 205° C. and the COLD offset is less than that of the conventional toner.

TABLE 2

| Toner # | HOT ° C. | COLD ° C. | 90 FR ° C. | Background |
|---|---|---|---|---|
| 1 | >205 | 165 | 173 | 0 |
| 2 | >205 | 155 | 169 | 0 |
| 3 | >205 | 155 | 170 | 0 |
| Conventional Control | >205 | 205 | 205 | 0.01 |

Figure 2:
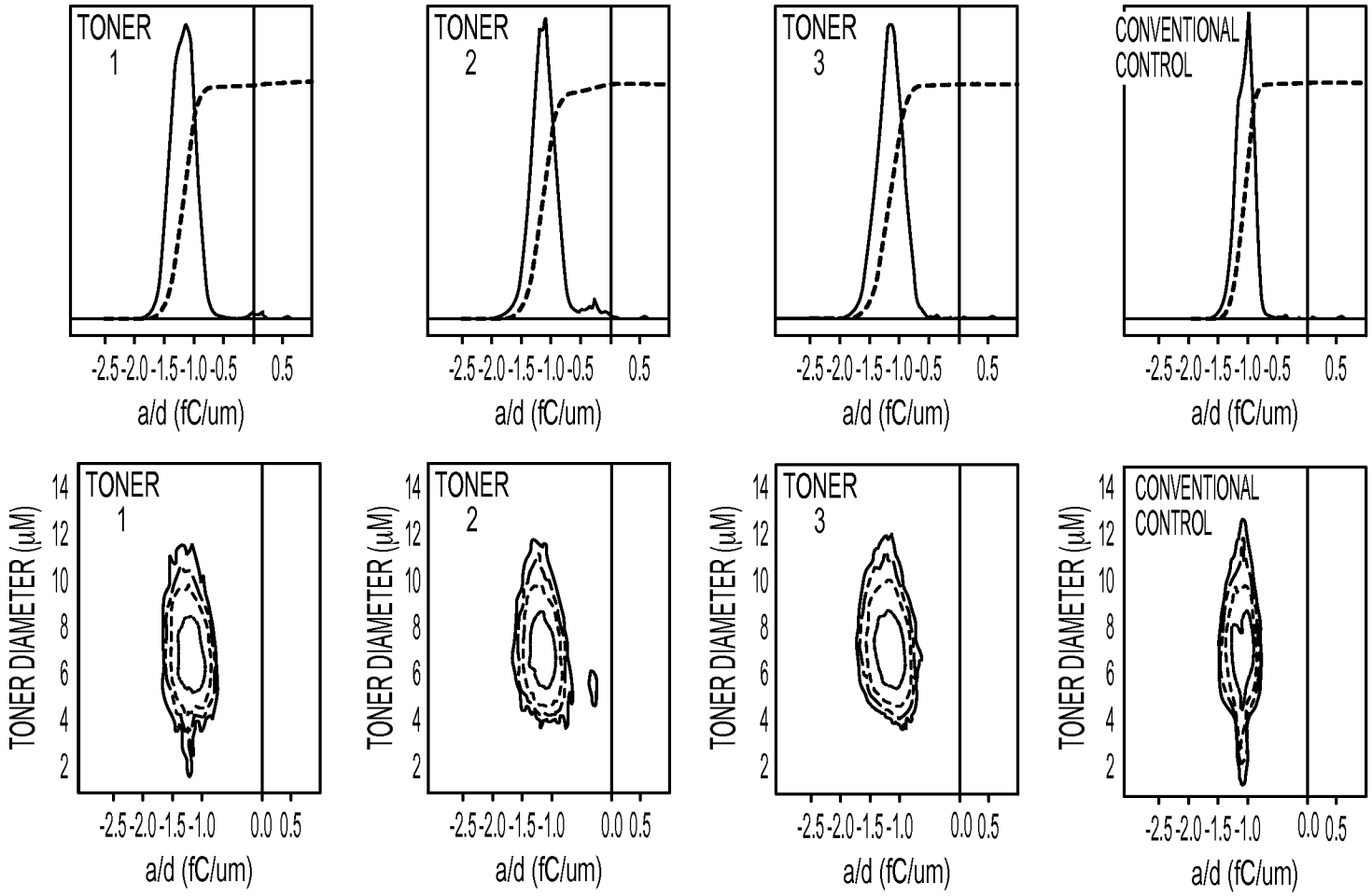
FIG. 2 is a comparison of the charge spectrographs of exemplary toner formulations of this disclosure with a conventional toner formulation.

The image density was tested by Xrite densitometer. After printing, the results were measured using a handheld machine to calculate the image density of a controlled area of the printed page. FIG. 2 is a comparison of the charge spectrographs of the toners versus the conventional toner. The toners are comparable in charging to the conventional toner and work equally well in the machines. The toner compositions may exhibit an image density of from about 1.2 to about 1.8.

Toners in accordance with the present disclosure provide for optimal gloss, release time and dwell time in the fuser as compared to conventional toners, and contribute to an improvement in clearing drum fog, morning drum fog in high heat/humidity (80/80), release, dwell time in fuser and print acuity when used on high speed SCD systems. The results in Table 3 demonstrate improved gloss of from about 10 to about 30 ggw, storage stability of about 20 gm or less and drum fog of 5% or less. These improved properties are important in terms of the interaction with the toner and photoreceptor.

TABLE 3

| Toner # | Gloss | Storage Stability | Drum Fog |
|---|---|---|---|
| 1 | 18 | 10 | 5 |
| 2 | 22 | 0 | 3.3 |
| 3 | 26 | 10 | 2.8 |
| Conventional Control | 21 | 20 | 7.2 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A composition having particles comprising:

a resin;

an optional wax;

a colorant;

a surface additive comprising a mixture of: a hexamethyldisilazane (HMDS) surface treated silica, a sol-gel silica that is not surface treated, and a polydimethylsiloxane (PDMS) surface treated silica; and an organic spacer comprising melamine and polymethylmethacrylate (PMMA);

wherein the weight ratio of the HMDS surface treated silica to the sol-gel silica to the PDMS silica is in a range of from about 0.45:0.15:2.3 to about 0.75:0.25:2.7 and the weight ratio of melamine to PMMA is in a range of from about 0.05:0.40 to about 0.15:0.60.

2. The composition of claim 1, wherein the HMDS surface treated silica has an average particle diameter of from about 5 to about 75 nm, the sol-gel silica has an average particle diameter of from about 90 to about 200 nm and the PDMS silica has an average particle diameter of from about 5 to about 75 nm.

3. The composition of claim 1, wherein the particles have a circularity of from about 0.920 to about 0.999.

4. The composition of claim 1, wherein the particles have a circularity of from about 0.955 to about 0.965.

5. The composition of claim 1, wherein the particles have a volume average diameter of from about 5 to about 12 μm.

6. The composition of claim 1, wherein the surface additive mixture is present in the composition in an amount from about 2 to about 5% based on the total weight of the composition.

7. The composition of claim 1, wherein the particles further comprise:

a core and a shell, the core comprising:

a resin including a first non-crosslinked polymer in combination with a crosslinked polymer, and the shell comprising: a second non-crosslinked polymer present in an amount of from about 27 to about 33 wt % of the toner;

a modified paraffin wax; and a colorant.

8. The composition of claim 7, wherein the first non-crosslinked polymer, the second non-crosslinked polymer, or both, comprise at least one monomer selected from the group consisting of styrenes, acrylates, methacrylates, butadienes, isoprenes, acrylic acids, methacrylic acids, acrylonitriles, and combinations thereof.

9. The composition of claim 7, wherein the crosslinked polymer is present in an amount of from about 6 to about 9% by weight of the toner.

10. The composition of claim 7, wherein the composition exhibits about 100% fix at 178° C. and about 80% fix below 175° C.

11. A composition having particles comprising:

a resin;

an optional wax;

a colorant;

a surface additive comprising a mixture of: a hexamethyldisilazane (HMDS) surface treated silica, a sol-gel silica that is not surface treated, and a polydimethylsiloxane (PDMS) surface treated silica; and an organic spacer comprising melamine and polymethylmethacrylate (PMMA), wherein the mixture of HMDS surface treated silica, sol-gel silica, and PDMS silica is present in the composition in an amount of from about 3.05 to about 4% based on the total weight of the composition and wherein the mixture of melamine and PMMA is present in the composition in an amount of from about 0.45 to about 0.65% based on the total weight of the composition.

* * * * *